US006370343B1

(12) United States Patent
Watanabe

(10) Patent No.: US 6,370,343 B1
(45) Date of Patent: Apr. 9, 2002

(54) IMAGE FORMING APPARATUS HAVING COLOR AND MONOCHROMATIC IMAGES TRANSFERRED TO INTERMEDIATE TRANSFER MEMBER

(75) Inventor: Kouichi Watanabe, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,734

(22) Filed: Sep. 26, 2000

(30) Foreign Application Priority Data

Sep. 28, 1999 (JP) ..... 11-275300

(51) Int. Cl.[7] ..... G03G 15/16
(52) U.S. Cl. ..... 399/66; 399/302; 358/300
(58) Field of Search ..... 399/40, 66, 178, 399/302, 297, 405, 403, 82, 83, 85; 358/1.17, 1.16

(56) References Cited

U.S. PATENT DOCUMENTS 5,481,365 A * 1/1996 Arimoto ..... 358/296
5,655,208 A * 8/1997 Sahay et al. ..... 399/397
5,870,648 A * 2/1999 Sakaki et al. ..... 399/66
5,987,290 A * 11/1999 Bisaiji ..... 399/296
6,029,023 A * 2/2000 Munemori et al. ..... 399/66
6,253,039 B1 * 6/2001 Nakano et al. ..... 399/53
6,266,497 B1 * 7/2001 Maekawa ..... 399/85

* cited by examiner

*Primary Examiner*—Robert Beatty
(74) *Attorney, Agent, or Firm*—Foley & Lardner

(57) ABSTRACT

Images to be printed include color images and monochromatic images in combination, the color and monochromatic images are transferred onto an intermediate transfer member, in such a manner that no image-bearable area of the intermediate transfer member is left unused. Before all the four colors of the color image are transferred to the intermediate transfer member, the printing of the monochromatic images are completed. A sheet bearing the printed monochromatic images are temporarily stacked and stored so that the sheets can be finally discharged in the original order of the images. In this manner, it is possible to make good use of the intermediate transfer member, thereby shortening the time required for image formation and improving the throughput of the printing operation.

11 Claims, 4 Drawing Sheets

IMAGE FORMING APPARATUS HAVING COLOR AND MONOCHROMATIC IMAGES TRANSFERRED TO INTERMEDIATE TRANSFER MEMBER

CROSS-REFERENCE TO RELATED APPLICATIONS

This application is based upon and claims the benefit of priority from the prior Japanese Patent Application No. 11-275300, filed Sep. 28, 1999, the entire contents of which are incorporated herein by reference.

BACKGROUND OF THE INVENTION

The present invention relates to an image forming apparatus, such as a digital copying machine capable of forming a color image and a monochromatic image, and also relates to an image forming system.

In recent years, image information have come to be available as digital data. A digital copying machine (a digital PPC) is an example of an apparatus using digital image data. Unlike a traditional analog PPC, the digital PPC does not form an image on a photosensitive body by optically guiding the reflected beam from an original document. The digital PPC first reads the reflected beam from the original document as electric signals by means of a CCD sensor, and then converts the electric signals into digital signals. The image data on the original document, which are in the form of digital data, are subjected to various kinds of processing, and then a printer section, such as a laser printer, prints an image on the basis of the processed image data.

In the manner described above, an image on the original document is first converted into digital signals. Then, on the basis of these digital signals, the input characteristics with reference to the CCD sensor and the output characteristics with reference to the laser printer can be controlled for a variety of purposes. These purposes include the correction of an image, the enlargement and reduction thereof, the deletion of part thereof, and the deletion of the frame thereof. It should be also noted that the digital signal processing described above is indispensable to the making of a color copy of a colored document.

After being converted into digital signals, the image data can be subjected to encoding processing. This encoding processing enables the image data to be compressed and stored with high efficiency. Images, thus stored, are reproduced by decoding, in such a manner that they can be printed in a desirable order. The number of images output by the laser printer is arbitrary. The electronic sort function, which utilizes this feature, is generally provided for the monochromatic digital PPC.

In comparison with the traditional analog PPC, which processes an image in the form of an optical signal, the digital PPC can process the image in the form of a digital signal. Owing to this, the digital PPC enables the connection layout of an image input device, an image processing device and an image output device to be determined with a remarkably high degree of freedom.

Traditional image forming apparatuses capable of executing color printing include a type that prints a color image by use of an intermediate transfer member to which image components to be developed in respective colors are transferred in a superposed manner. Let us consider a case where an image forming apparatus employing this type of intermediate transfer member is used for printing a monochromatic image and a color image in succession. Normally, a black image is transferred to the intermediate transfer member when the monochromatic image is formed, and four different-color image components are superposed thereon when the color image is formed. If the intermediate transfer member is a member that can bear images corresponding to two pages, it can form monochromatic images corresponding to up to three pages in the period of time when four different color image components corresponding to one page are transferred. Therefore, when the traditional image forming apparatus prints a monochromatic image in succession to a color image, sheets bearing print results are discharged in the order of pages. Therefore, the monochromatic image is transferred onto the intermediate transfer member after four different color image components have been transferred onto the intermediate transfer member.

When the traditional image forming apparatus functioning as a copying machine is used, the original documents should preferably be either monochromatic documents or color documents. If these two kinds of documents are mixed, the order of documents and the order of sheets bearing print results must be controlled to agree with each other. The orders must be controlled even if the intermediate transfer member can bear a plurality of images. This being so, the monochromatic image must be transferred to the intermediate transfer member after the color image components are transferred thereto.

As described above, the traditional image forming apparatus has to be controlled in such a manner that the order of images agrees with the order in which sheets bearing printed images are printed, and the control is required even if the intermediate transfer member of the image forming apparatus can bear images corresponding to two or more pages. Due to this, the intermediate transfer member cannot bear both a monochromatic image and a color image at the same time. When a color image is printed in succession to a monochromatic image, all image components required for forming the color image have to be first transferred to the intermediate transfer member, and then the monochromatic image has to be transferred to the intermediate transfer member. When the image components required for forming the color image are being transferred onto the intermediate transfer member, the area of the intermediate transfer member to which the monochromatic image is to be transferred is left unused. The throughput (i.e., the processing capacity per unit time) is degraded, accordingly.

BRIEF SUMMARY OF THE INVENTION

As described above, when monochromatic images and color images are printed in a mixed state, a monochromatic image to be printed immediately after a color image is transferred to the intermediate transfer member after all color components of the color image have been completely transferred to the intermediate transfer member, with the result that that the throughput of the print processing is degraded. Accordingly, an object of the present invention is to provide an image forming apparatus and an image forming system which are free of the problems described above, which enables a monochromatic image and a color image to be printed in combination without having to wait for all colors of the color image to be transferred to the intermediate transfer member, and which enables efficient use of the image bearing area of the intermediate transfer member, thereby improving the throughput of the printing operation.

According to the present invention, there is provided an image forming apparatus comprising: an image storage device for storing image data in an order of pages; an image determination section for determining whether the image data are about a single-color image which can be formed in a single color or about a multi-color image which must be formed in a plurality of colors; an intermediate transfer member for bearing an image, which is an image obtained by superposing single-color images when a determination result by the image determination section indicates the multi-color image or is an image obtained by use of the single color when the determination result by the image determination section indicates single-color image; a control section for forming images on the intermediate transfer member in an order of pages of the image data where the intermediate transfer member can bear images corresponding to a plurality of pages, even when the images are determined to be different types by the image determination section; a transfer section for sequentially transferring the images, formed on the intermediate transfer member by the control section, onto image formation mediums; a fixing unit for fixing images, transferred onto the image formation mediums, to the image formation mediums; a stack section for temporarily stacking image formation mediums bearing fixed images, when an order of the image formation mediums on which the images are fixed by the fixing unit differs from the order of the pages of the image data; and a discharge section for discharging the image formation mediums temporarily stacked in the stack section, and discharging image formation mediums bearing images that are fixed thereon after the images on the image formation mediums stacked in the image formation mediums, such that the image formation mediums are discharged in the order of the pages of the image data.

According to the present invention, there is also provided an image forming apparatus comprising: an image storage device for storing image data corresponding to a plurality of pages; an image determination section for determining whether the image data are about a single-color image which can be formed in a single color or about a multi-color image which must be formed in a plurality of colors; an intermediate transfer member for bearing an image, which is an image obtained by superposing single-color images when a determination result by the image determination section indicates the multi-color image or is an image obtained by use of the single color when the determination result by the image determination section indicates single-color image; a control section for confirming that the intermediate transfer member can hold images corresponding to a plurality of pages, and then forming the multi-color image on the intermediate transfer member prior to the single-color image even if the multi-color image succeeds to the single-color image, the control section operating when the image storage device stores all image data that correspond to a plurality of pages including single-color and multi-color images in combination; a transfer section for sequentially transferring images, formed on the intermediate transfer member by the control section, onto image formation mediums; a fixing unit for-fixing images, transferred onto the image formation mediums, to the image formation mediums; and a discharge section for discharging the image formation mediums on which images are fixed by the fixing unit.

According to the present invention, there is further provided an image forming apparatus comprising: an image storage device for storing image data corresponding to a plurality of pages; an image determination section for determining whether the image data are about a single-color image which can be formed in a single color or about a multi-color image which must be formed in a plurality of colors; an intermediate transfer member for bearing an image, which is an image obtained by superposing single-color images when a determination result by the image determination section indicates the multi-color image or is an image obtained by use of the single color when the determination result by the image determination section indicates single-color image; a control section for confirming that the intermediate transfer member can hold images corresponding to a plurality of pages, and then forming images on the intermediate transfer member, such that images which are determined as being of one type by the image determination section and born on the intermediate transfer member in unit of a number that can be born on the intermediate transfer member at a time, the control section operating when the image storage device stores all image data that correspond to a plurality of pages including single-color and multi-color images in combination; a transfer section for sequentially transferring images, formed on the intermediate transfer member by the control section, onto image formation mediums; a fixing unit for fixing images, transferred onto the image formation mediums, to the image formation mediums; a stack section for temporarily stacking image formation mediums bearing fixed images, when an order of the image formation mediums on which the images are fixed by the fixing unit differs from the order of the pages of the image data; and a discharge section for discharging the image formation mediums temporarily stacked in the stack section, and discharging image formation mediums bearing images that are fixed thereon after the images on the image formation mediums stacked in the image formation mediums, such that the image formation mediums are discharged in the order of the pages of the image data.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
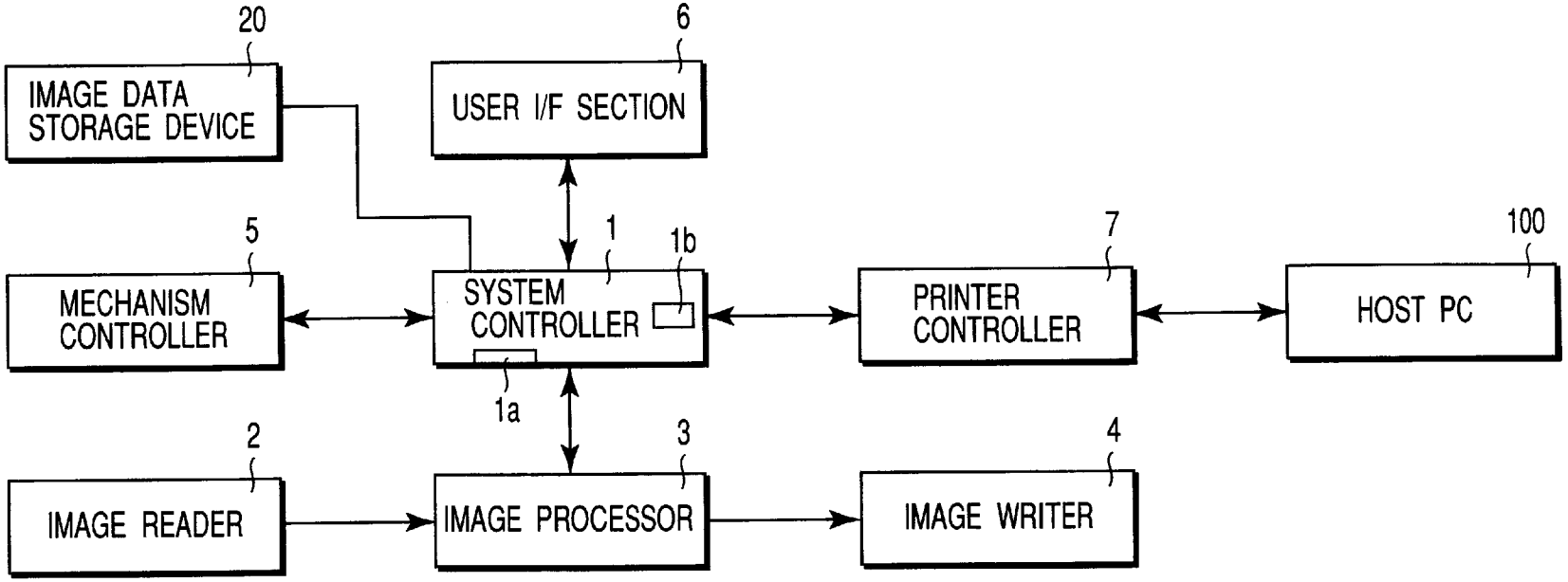
FIG. 1 is a block circuit diagram illustrating the control system of an image forming apparatus according to the present invention.

FIG. 1 is a block circuit diagram illustrating the control system of an image forming apparatus (system) according to an embodiment of the present invention.

As shown in FIG. 1, the control system of the image forming apparatus comprises a system controller 1, an image reader 2, an image processor 3, an image writer 4, a mechanism controller 5, a user I/F section 6, a print controller 7, an image data storage device 20, etc. A host PC (a host computer) 100 is connected to the printer controller 7, so that an image forming system is provided.

The system controller 1 controls the image forming apparatus by controlling each of its structural elements. The image reader 2 scans an original document by irradiating it with light emitted from a light source. The light reflected by the original document is guided to a color CCD sensor. By this color CCD sensor, the light reflected by the original document is converted into electric signals, each corresponding to the color of a pixel. In this manner, the digital image data are obtained from the image on the original document.

The system controller 1 is provided with a page memory 1*a* corresponding to the image bearing area of the intermediate transfer member 10. Where the page memory 1*a* has a storage area corresponding to one A3-size image, the storage area is divided into two, so that two A4-size images can be stored. The system controller 1 is also provided with an image determination section 1*b* which determines whether an input image, such as an image read from the image reader 2, is an monochromatic image or a color image.

The image processor 3 executes various kinds of image processing with respect to the image (image data) read by the image reader 2. The image processing executed by the image processing section 3 is, for example, gamma correction, color conversion, main-scan direction scaling, image separation, editing, area processing, or gradation correction. The image writer drives an LD (a laser diode) in accordance with image data, and forms an electrostatic latent image on a photosensitive drum 8, which will be described below. The mechanism controller 5 controls the mechanisms of units, which will be also described below. An input device, from which the user enters operation settings, and a display device, on which a setting menu is shown, are connected to the user I/F section 6.

The printer controller 7 is a control device that enables the image forming apparatus to be used as a color printer. The image data storage device 20 stores image data that are either read or supplied thereto through the printer controller. The image data stored in the image data storage device correspond to a plurality of pages.

The host PC 100 is an external device for supplying a print command to the printer controller 7. The host PC 100 may be a personal computer (PC) which is connected through a network and which supplies an image print command to the printer controller 7. The printer controller 7 and the host PC 100 are options unless the image forming apparatus is used as a printer.

Figure 2:
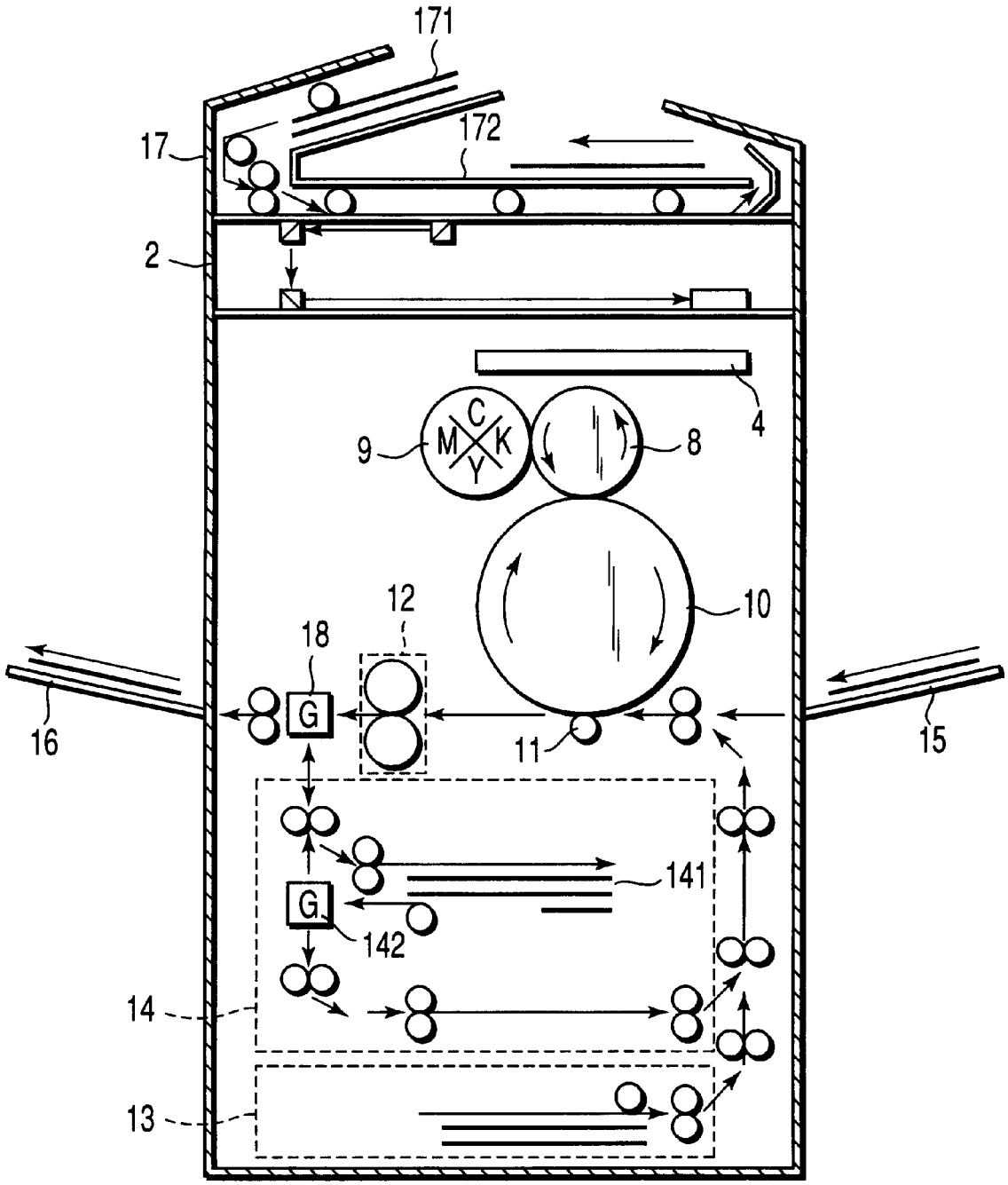
FIG. 2 is a sectional view showing the internal structure of a digital copying machine, which is an example of the image forming apparatus.

FIG. 2 is a sectional view schematically showing the internal structure of a digital copying machine (a digital PPC), which is an example of the image forming apparatus. As shown in FIG. 2, the digital copying machine comprises an image reader 2, an image writer 4, a photosensitive drum 8, a developer unit 9, an intermediate transfer member 10, a sheet transfer section 11, a fixing unit 12, a sheet feeder 13, an automatic reversing device (ADU) 14, a manual insertion section 15, a sheet discharge section 16, an automatic document feeder (ADF) 17, etc.

The image reader 2 scans an original document by irradiating it with light emitted from the light source. The light reflected by a color CCD sensor is guided to a color CCD sensor. This color CCD sensor converts the light into digital signals, which have color components corresponding to the respective pixels. The image writer 4 modulates or controls the driving of an LD (a laser diode not shown) in accordance with the image data.

An electrostatic latent image is formed on the photosensitive drum 8 by means of the LD driven by the image writer 4. The developer unit 9 visualizes the electrostatic latent image formed on the photosensitive drum by supplying various colors of toner thereto.

The intermediate transfer member 10 has an image bearing area (surface), on which a visualized image is transferred from the photosensitive drum 8. The size of the image bearing area corresponds to the maximal size of an image that can be printed by the image forming apparatus. For example, if the maximal size of a printable image is A3, this follows that the intermediate transfer member 10 has an image bearing area of A3 size. When the intermediate transfer member having this image bearing area is used for printing A4 size images, the image bearing area is divided into halves, and images corresponding to two pages are transferred thereto.

The sheet transfer section 11 transfers an image or images from the intermediate transfer member 10 to a sheet. The fixing unit 12 comprises a fixing roller and a pressure-applying roller and thermally fixes the images onto the sheet. The sheet feeder 13 feeds sheets, i.e., mediums on which an image is to be formed.

The automatic reversing device (ADU) 14 reverses a sheet after an image is transferred onto one side of that sheet. After being reversed, the sheet is supplied to the sheet transfer section 11 once again. The automatic reversing device (ADU) 14 has an FIFO (first-in, first-out) stack section 141. Sheets onto which images are printed are temporarily stored in the stack section 141, and are taken out therefrom later. Owing to the function of the stack section 141, the discharging order of sheets, on which images are formed by the sheet transfer section 11 and the fixing unit 12, can be controlled. The automatic document feeder (ADF) 17 supplies a number of pages of a document to the read position (not shown) of the image reader 2 one by one.

The operation of the image forming apparatus of the above structure will now be described.

The system controller 1 controls the image reader 2 to scan an original document and to convert the image on the document into color image data. At the time, the page memory 1*a* of the system controller 1 stores the image data, and the image determination section 1*b* thereof determines whether the read image is a color image or a monochromatic image. The image data are supplied to the image processor 3.

Under the control of the system controller 1, the image processor 3 executes various kinds of processing with respect to the image data read by the image reader 2. For example, γ correction, color conversion, main-scan direction scaling, image separation, editing, area processing, or gradation correction is executed. The image data subjected to these kinds of processing are transmitted to the image writer 4.

In accordance with the image data transmitted from the image processor 3, the image writer 4 modulates the driving of t he LD (laser diode). A laser beam emitted from the LD is radiated to the photosensitive drum 8, which is uniformly charged, when the photosensitive drum 8 is rotating. As a result, an electrostatic latent image is formed on the photosensitive drum 8. From the developer section 9, developers are supplied to the electrostatic latent image on the photosensitive drum 8 according to the colors, namely, black, cyan, magenta and yellow. In this manner, the toner of each color adheres to the photosensitive drum, thereby visualizing the latent image. The visualized image is then transferred from the photosensitive drum 8 to the intermediate drum 8.

In the case of full-color printing, the image on the photosensitive drum 8 is visualized in four different colors, namely, black, cyan, magenta and yellow. Accordingly, an image is transferred from the photosensitive drum 8 to the intermediate transfer member 10 four times, and four colors of toner (namely, black, cyan, magenta and yellow) are sequentially transferred onto the intermediate transfer member 10.

In the case of full-color printing, the system controller 1 controls the sheet feeder 13 to start a sheet feeding operation in synchronism with the operation of the intermediate transfer member 10. This sheet feeding operation is performed after the four color images have been transferred onto the intermediate transfer member 10. The sheet fed into the image forming apparatus may be a sheet manually inserted from a manual sheet insertion tray 15. Onto the sheet fed in this manner, the four-color toner images that are overlaid on the intermediate transfer member 10 by the sheet transfer section 11 are transferred at a time on the sheet fed by the sheet feeder 13.

In the case of monochromatic printing, one-color toner (black toner) is transferred from the photosensitive drum 8 onto the intermediate transfer member 10. In this case, the image formation step and the transfer step are first completed, as in the case of full-color printing. Then, a sheet feeding operation is performed in synchronism with the operation of the intermediate transfer member 10. The sheet fed into the image forming apparatus may be a sheet manually inserted from a manual sheet insertion tray 15. Onto the sheet fed in this manner, the black-toner image transferred on the intermediate transfer member 10 by the sheet transfer section 11 is transferred on the sheet fed by the sheet feeder 13.

The sheet, on which the four-color toner images or monochromatic toner image has been transferred, is supplied to the fixing unit 12 along the conveyance path. By this fixing unit 12, the toner is thermally fixed on the sheet by means of a fixing roller and a pressure-applying roller. After the toner is fixed by the fixing unit 12, the sheet is discharged by the sheet discharge section 16. In this manner, a document image is formed on the sheet.

The selection of the copy mode or other settings made by the user are entered from the user I/F section 6. The settings made by the user, including the selection of the copy mode, are supplied to the system controller 1. The system controller 1 performs control processing required for the copy mode selected or the settings made. Specifically, the system controller 1 executes the control processing by supplying control signals to the image reader 2, the image writer 4, the user I/F section 6, the automatic reversing device 14, the automatic document feeder 17, etc.

The automatic document feeder (ADF) 17 will be described. As shown in FIG. 2, the automatic document feeder 17 is located above the image reader 2. The automatic document feeder 17 includes a document inlet tray 171 and a document outlet tray 172. The user puts a document on the document inlet tray 171 and designates the start of a copying operation and a sheet feed operation. In response to the user's designation, the sheet on the document inlet port is automatically fed. An image on the document is read by the image reader 2, and thereafter the sheet is discharged onto the document outlet tray 172.

The automatic reversing device 14 (hereinafter referred to as an ADU 14) will be described. The ADU 14 has three functions described below.

The first function is to discharge a sheet, with its reverse side up. Owing to this function, a sheet has its printed side up (this state will be hereinafter referred to as a "face up" state) when the toner is fixed thereon by the fixing unit 12, and has its printed side down (this state will be hereinafter referred to as a "face down" state) when the sheet is discharged from the apparatus.

As shown in FIG. 2, the sheet onto which the toner is fixed by the fixing unit 12 is guided toward the ADU 14 by a sheet feed path-switching gate 18. When the trailing end of the sheet has passed through the switching gate 18, the sheet guided to the ADU 14 is stopped and is fed in the opposite direction and fed onto the sheet discharge section 16. In this case, the sheet is discharged without being stacked in the FIFO (first-in, first-out) stack section 141.

Where images of the document are sequentially formed from the image on the first page, the function described above is useful in making the order of image pages agree with the order of the printed sides of sheets. To be more specific, when a number of pages are read, and printed sheets are discharged in the "face down" state, the sheets are sequentially stacked, with their printed sides down, and the lowermost sheet of the stack is the first page. In other words, the sheets in the discharged state have their printed sides agree with the order of image pages.

The second function is to temporarily stack sheets in the reversed state and start discharging the stacked sheets at appropriate timings. When this function is used, the sheets having passed through the fixing section 12 are stacked on the stack section, with their printed sides reversed. The sheets, thus stacked on the stack section, are discharged onto the sheet discharge section 16 at appropriate timings in the order in which they were stacked.

As can be seen from FIG. 2, the sheets to which toner is fixed by the fixing unit 12 are conveyed toward the ADU 14 by the sheet feed path-switching gate 18. The sheets conveyed to into the ADU 14 are stacked in the stack section 141 in the reversed state. The sheets stacked in the stack section are taken out at the sheet discharge timing provided by the system controller 1, in such a manner that the lowermost sheet of the stack is taken out first of all. In this manner, the sheets are discharged in the order in which they were stacked. In this case, the sheets are discharged onto the sheet discharge section in the "face down" state by way of the sheet path-switching gates 142 and 18.

This function is useful in discharging sheets at desirable timings. When the printing process executed in the order of image pages comes to an end prior to the time when the sheets must be discharged, the printed sheets are stored in the stack section 141. When the desirable sheet discharge time comes, the sheets are discharged from the stack section 141. Owing to this function, even when the printing process is completed too soon, the order in which the sheets are discharged agrees with the order in which document images are printed.

The third function is to supply sheets to the sheet transfer section 11, with the sheets reversed. This function enables images to be printed on both sides of a sheet.

As shown in FIG. 2, a sheet, on which toner is fixed by the fixing unit 12, is fed to the ADU 14 through the sheet path-switching gate 18. The sheet fed to the ADU 14 is stacked on the stack section 14, with its reverse side up.

The sheets stacked in the stack section 141 are taken out at predetermined timings, and then guided to the sheet feed path by the sheet path-switching gate 142. The sheet is supplied to the sheet transfer section 11 once again.

The sheet supplied to the sheet transfer section 11 is in the state wherein an image can be formed on the reverse side. After the image is formed on the reverse side, the sheet is discharged onto the sheet discharge section 16.

By utilizing the circulation path used in connection with the double-sided printing, it is possible to adjust the order in which sheets are discharged, as in the manner explained in connection with the second function. In this case, the sheets are stored in the circulation path, not in the stack section 141, and the order in which the sheets are discharged can be adjusted by use of that path. The condition enabling the control of this sheet discharge order is that the circulation path must contain more than a given number of sheets.

In the case where the circulation path for the double-sided printing is used for the control of the sheet discharge order, the stack section 141 is not required (the sheet reversing mechanism is required), and the structure of the entire apparatus can be simplified, accordingly. On the other hand, the sheets have to pass through the sheet transfer section 11 and the fixing unit 12 repeatedly, the time required until the sheets are discharged may be long.

The deterioration in the printing throughput, which is attributable to the unused period of the intermediate transfer member 10, is compensated for in the first, second and third embodiments of the present invention. These embodiments will now be described.

First of all, the first embodiment will be described.

In connection with this embodiment, reference will be made to the case where the order in which images are printed is not controlled. If the print order control by "electronic sort" is not performed when a plurality of documents are copied, the image print order is not controlled. The image print order is not controlled, either, if the host PC 100 cannot designate image printing in orders other than the printing order, or if the printer controller 7 does not enable generation of image data in orders other than the printing order with respect to the images supplied from the host PC 100.

The "electronic sort" described above is intended to refer to the processing where a plurality of images are temporarily stored in the image data storage device 20 and where image data are read out from the image data storage device 20 and processed in an arbitrary order. As can be seen from this, the use of the electronic sort enables control of the print order in which image data are subjected to printing. However, the first embodiment will be described, referring to the case where the printing order is not controlled.

Let us assume that a plural-page document is set on the document feeder 17. In this case, the document feeder 17 feeds the document to the image reader 2 page by page. The image reader 2 reads one page of the document and supplies the read data to the system controller 1 as full-color image data. In the system controller 1, the page memory 1*a* stores the one-page image data supplied from the image reader 2, and the image determination section 1*b* determines whether the read document is a color document or a monochromatic document.

Let us assume that the page memory 1*a* has a storage capacity capable of storing image data of A3 size, which is a maximal print size. When A4 size images are printed, the page memory 1*a* is divided into halves, and images corresponding to two pages are stored in the page memory 1*a*. Where A4 size images are printed, the two storage areas of the page memory 1*a* are alternately used. By using the storage areas in this manner, the operation for reading an image in the page memory 1*a* and the operation for reading out an image therefrom can be executed simultaneously. In the description below, the image data will be referred to as corresponding to A4 size, and the page memory 1*a* will be referred to as having areas corresponding two pages. One of the two areas of the page memory 1*a* will be referred to as area A, and the other area will be referred to as area B.

Where the image data to be stored in the page memory 1*a* is color image data, they include K (black) C (cyan), M (magenta) and Y (yellow) components for each pixel. When a color image is printed, the image data are developed in one color at one time, and the resultant developed data are transferred to the intermediate transfer member 10.

The images of the four colors are superposed on the intermediate transfer member 10. When a full-color image is to be printed, the intermediate transfer member is rotated four times, the superposed images are transferred onto a sheet. When a monochromatic image is transferred, the color-image superposition described above is not performed. The image is developed in only one color (black), and the developed image is transferred onto the intermediate transfer member 10 and then onto a sheet.

The intermediate transfer member 10 has size corresponding to A3, which is a maximal print size. When A4-size images are to be printed, the intermediate transfer member can bear images corresponding to two pages. In the description below, the image data to be printed will be referred to as corresponding to A4 size, and the intermediate transfer member 10 will be referred to as being capable of bearing two images corresponding to areas A and B of the intermediate transfer member 10.

The intermediate transfer member 10 capable of simultaneously bearing two-page images can be used for successively printing images that includes color and monochromatic images. If, in this case, the color images and the monochromatic images are printed independently of each other, the intermediate transfer member 10 may not be used with high efficiency; there will inevitably be a period of time when the intermediate transfer member 10 is left unused.

Let us consider the case where a color image and a monochromatic image are successive. The color image is formed by superposing colors on the intermediate transfer member 10 four times, while the monochromatic image is formed by transferring a black image on the intermediate transfer member 10 only once. If the formation of the color image and that of the monochromatic image are started at the same time, the monochromatic image is transferred onto the sheet and fixed thereon prior to the color image. That is, the image formation processing for the monochromatic image comes to completion when the image formation processing for the color image is still being executed.

If sheets are discharged in the order in which image formation is completed, it follows that the printing for the monochromatic image comes to end before the printing for the color image. To control the sheet discharge order, therefore, sheets on which images are transferred are stored in the image forming apparatus in such a manner that they can be discharged from the image forming apparatus in the same order as the pages of the document.

As can be seen from the above, the operation for discharging the sheets stored inside the image forming apparatus can be performed independently of the operation for transferring a toner image onto a sheet and the operation for fixing the toner image to the sheet. Even if the printing order cannot be changed, the sheet discharging order never fails to agree with the order of the pages of the document. In addition, the period of time in which the intermediate transfer member 10 is left unused can be as short as possible.

Since a monochromatic image is formed by transferring black toner only once, and a color image by executing color superposition four times, it is possible that the monochromatic printing for up to three pages will be completed before the color printing for one page is completed. In other words, the maximal number of pages that must be stored inside the image forming apparatus to control the sheet discharge order is three.

In the above description, reference was made to the case where image data obtained by the image reader 2 were processed. When the image forming apparatus is used as a printer, image data are processed in a similar manner. In this case, however, the image data is supplied not from the image reader 2 but from either the host PC 100 or the printer controller 7.

Figure 3:
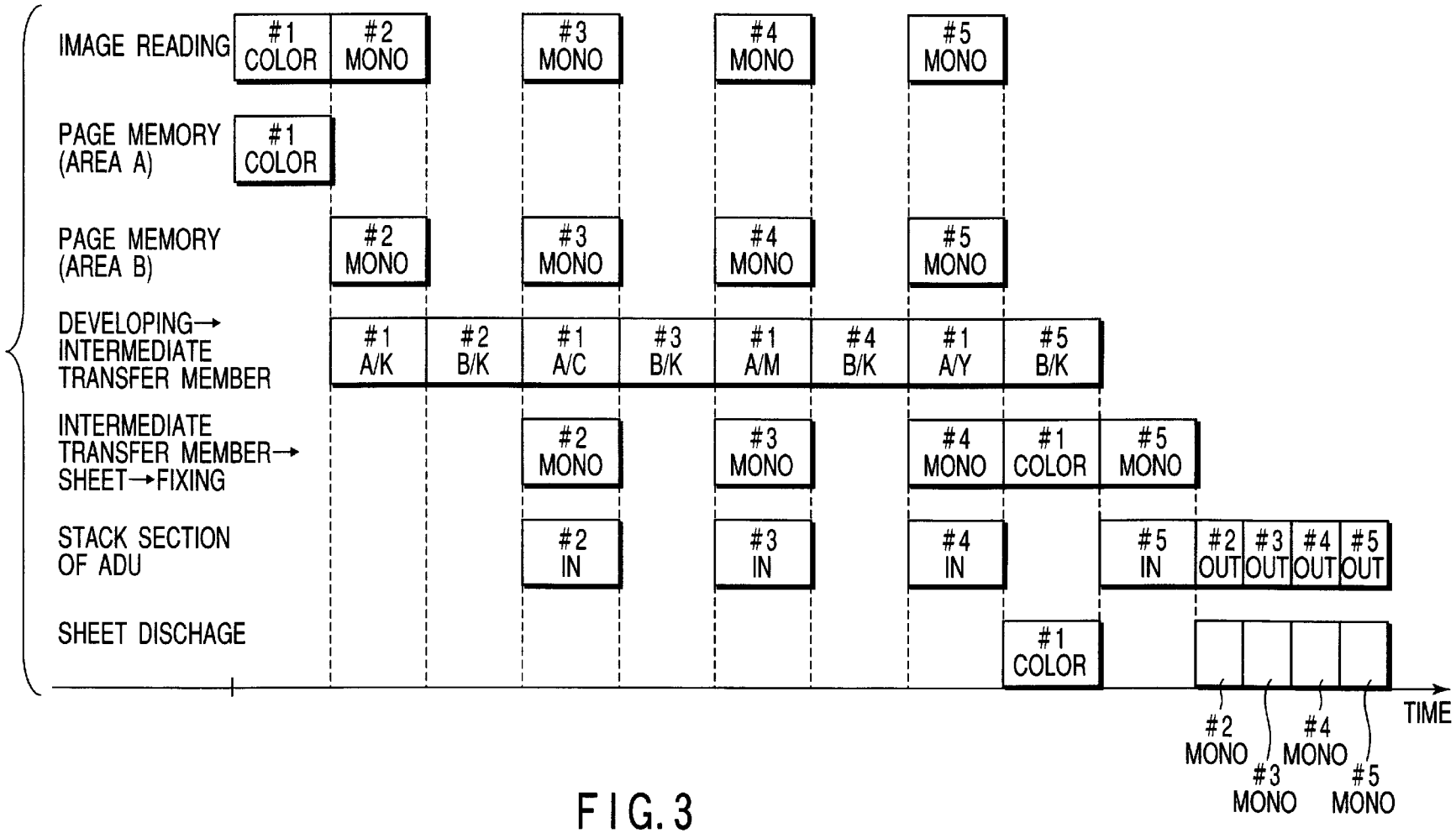
FIG. 3 illustrates how images corresponding to a number of pages are processed according to the first embodiment, when the images include color ones and monochromatic ones in combination.

With reference to FIG. 3, a description will be given as to how the apparatus of the first embodiment operates.

FIG. 3 shows a sequence in which the digital copying machine makes a copy of a document consisting of five pages. Of these five pages, the first page is a color image (#1, color), the second page is a monochromatic image (#2, mono), the third page is a monochromatic image (#3, mono), the fourth page is a monochromatic image (#4, mono), and the fifth page is a monochromatic image (#5, mono).

In FIG. 3, the axis of abscissa represents time, and the processing sequences are indicated such that they are aligned in the columnar direction. The document indicated in FIG. 3 consists of five A4 pages that include color and monochromatic images in a mixed state. The five pages of the document are set on the document feeder 17 in the order of color (#1)→monochromatic (#2)→monochromatic (#3)→monochromatic (#4)→monochromatic (#5). In FIG. 3, "A" denotes one of the two areas of the intermediate transfer member 10 (Area A), while "B" denotes the other area of the intermediate transfer member 10 (Area B).

First of all, the image reader 2 reads the first page (#1, color) of the document. The image on the first page is read by the image reader 2, and the data obtained thereby are stored on area A of the page memory 1*a* (#1, color).

When the image reader 2 has just read the first page, it starts reading the second page (#2, mono). The image on the second page is read by the image reader 2, and the data obtained thereby are stored on area B (#2, mono).

On the basis of the image data stored in area A of the page memory 1*a,* i.e., the image data on the first page of the document, the system controller 1 determines whether the first page is a color document or a monochromatic document. If the system controller 1 determines that the first page is a color document, an image developed in black (K) is transferred onto area A of the intermediate transfer member 10 as the first-color image corresponding to the image data on the first color page of the document (#1, A/K).

When the second page of the document has been read, the system controller 1 determines that the second page of the document is a monochromatic document. This determination is made on the basis of the image data stored in area B of the page memory 1*a* and corresponding to the second page of the document. When the second page of the document has been determined as such, the system controller 1 transfers an image developed in black (K) and corresponding to the second page onto area B of the intermediate transfer member 10 (#2, B/K).

When the image corresponding to the second page of the document has been transferred onto the intermediate transfer member 10, the system controller 1 controls the image reader to read an image from the third page of the document (#3, mono). At the time, the system controller 1 stores the image of the third page of the document in area B of the page memory 1*a,* in place of the developed image of the second page (#3, mono).

On area A of the intermediate transfer member 10, an image developed in cyan (C) is transferred as the second-color image corresponding to the first color page of the document (#1, A/K). Simultaneous with this, the monochromatic image developed on area B of the intermediate transfer member 10 and corresponding to the second page is transferred onto a sheet, and is then fixed thereon (#2, mono). The sheet, on which the image of the second page is printed in the monochromatic manner, is not discharged from the apparatus but stacked in the stack section 141 of the ADU 14 (#2, in).

When the image of the third page has been read, the system controller 1 controls the image determination section 1*b* to determine that the image of the third page, which is stored on area B of the page memory 1*a,* is a monochromatic image. Then, the system controller transfers the image developed in black (K) and corresponding to the third page onto area B of the intermediate transfer member 10 (#3, B/K).

When the image corresponding to the third page of the document has been transferred onto the intermediate transfer member 10, the system controller 1 controls the image reader 2 to read the fourth page of the document (#4, mono). At the time, the system controller 1 stores the image corresponding to the fourth page of the document, in place of the developed image corresponding to the third page (#4, mono).

On area A of the intermediate transfer member 10, an image developed in magenta (M) is transferred as the third-color image corresponding to the first page of the document (#1, A/M). Simultaneous with this, the monochromatic image developed on area B of the intermediate transfer member 10 and corresponding to the third page is transferred onto the sheet, and is then fixed thereon (#3, mono). The sheet, on which the image of the third page is printed in the monochromatic manner, is not discharged from the apparatus but stacked in the stack section 141 of the ADU 14 (#3, in).

When the image of the fourth page has been read, the system controller 1 controls the image determination section 1*b* to determine that the image of the fourth page, which is stored on area B of the page memory 1*a,* is a monochromatic image. Then, the system controller transfers the image developed in black (K) and corresponding to the fourth page onto area B of the intermediate transfer member 10 (#4, B/K).

When the image corresponding to the fourth page of the document has been transferred onto the intermediate transfer member 10, the system controller 1 controls the image reader 2 to read an image from the fifth page of the document (#5, mono). At the time, the system controller 1 stores the image corresponding to the fifth page of the document, in place of the developed image corresponding to the fourth page (#5, mono).

On area A of the intermediate transfer member 10, an image developed in yellow (Y) is transferred as the fourth-color image corresponding to the first page of the document (#1, A/Y). Simultaneous with this, the monochromatic image developed on area B of the intermediate transfer member 10 and corresponding to the fourth page is transferred onto the sheet, and is then fixed thereon (#4, mono). The sheet, on which the image of the fourth page is printed in the monochromatic manner, is not discharged from the apparatus but stacked in the stack section 141 of the ADU 14 (#4, in).

When the image of the fifth page has been read, the system controller 1 determines that the image of the fifth page, which is stored on area B of the page memory 1*a,* is a monochromatic image. Then, the system controller transfers the image developed in black (K) and corresponding to the fourth page onto area B of the intermediate transfer member 10 (#5, B/K).

In this manner, the four-color image required for color printing are developed on area A of the intermediate transfer member 10. Owing to this, the color image corresponding to the first page, which is developed on area A of the intermediate transfer member 10, is transferred onto the sheet and then fixed thereon (#1, color). The sheet, on which the color image corresponding to the first page is formed, is discharged onto the sheet discharge section 16 (#1, color).

When the image corresponding to the fifth page of the document has been transferred onto the intermediate transfer member 10, the monochromatic image corresponding to the fifth page and transferred onto area B of the intermediate transfer member 10 is transferred onto a sheet, and then fixed thereon (#5, mono). The sheet, on which the image of the fifth page is printed in the monochromatic manner, is not discharged from the apparatus but stacked in the stack section 141 of the ADU 14 (#5, in).

After the end of these operations, the four sheets stacked in the stack section 141 of the ADU 14 and bearing the images corresponding to the second, third, fourth and fifth pages of the document, are discharged onto the sheet discharge section 16 in the order of the second page, the third page, the fourth page and the fifth page (#2, out), (#3, out), (#4, out) and (#5, out). In this manner, the sheets bearing printed images are discharged onto the sheet discharge section 16 in the order of the pages of the images.

As described above, when a color image precedes monochromatic images, the image transfer is performed in such a manner that the monochromatic images are transferred by use of one of the areas of the intermediate transfer member 10 before the color image is transferred in four colors by use of the other area of the intermediate transfer member 10.

Owing to this feature, the operation of transferring the monochromatic images need not be delayed until the completion of the operation of transferring the color image. The time needed for image formation can be shortened, accordingly.

The sheets on which the monochromatic images are printed are stacked in the ADU before the completion of the printing of the color image that precedes the monochromatic image. After the sheet on which the color image is printed is discharged, the sheets stacked in the ADU are discharged.

Owing to this feature, the time required for forming a plurality of images can be shortened. In addition, the sheets, including sheets bearing monochromatic images, can be discharged in the order of the images, without having to wait for the completion of the printing of the color image.

A description will now be given of the second embodiment of the present invention.

In the second embodiment described below, reference will be made to the case where the order in which the images are printed is determined in accordance with the number of images that can be held on the intermediate transfer member 10, i.e., the case where the images are grouped into color ones and monochromatic ones, and the images of each group are printed independently of the images of the other groups.

For example, when images on a plurality of pages are copied, the printing order in which the second and subsequent copies are made can be controlled by electronic sort. The printing order can be controlled when the host PC 100, serving as an external device, outputs print commands in a different order from the printing order, or when the printer controller 7 can process images supplied from an external device and generate image data that can be printed in an arbitrary manner.

Since the printing order can be controlled in the manner, the images can be grouped into monochromatic ones and color ones and can be printed according to these groups, in accordance with the number of images that can be held on the intermediate transfer member 10. Owing to this feature, it is possible to shorten the period of time when the intermediate transfer member is left unused.

Where the intermediate transfer member 10 can hold two images, two of the monochromatic images or two of the color images are transferred onto the intermediate transfer member 10. If sheets are discharged in the order in which images are printed, the order of the images on the discharged sheets may not be the same as the order in which the images of the original document are arranged. To prevent this problem, the sheet discharge order is controlled.

According to the second embodiment, the order in which images are developed or transferred onto the intermediate transfer member 10 can be controlled based on the electronic sort function or by using the host PC 100 or printer controller 7. According to the second embodiment, the type of image formed on each page of a document is detectable or is known beforehand.

When the electronic sort is selected, the image determination section 1*b* determines whether the document to be read is a color image or a monochromatic image. When images supplied from the host PC 100 are to be printed, information representing the type of each image are sent from the host PC 100 along with printing commands. On the basis of those information, the image determination section 1*b* determines whether the image to be printed is a color image or a monochromatic image.

The order in which the images are developed or transferred onto the intermediate transfer member 10 is adjusted in such a manner that the intermediate transfer member 10 bears two monochromatic images or two color images. By this order control, sheets on which images are printed before the completion of the printing of preceding images are stored in the image forming apparatus, to thereby adjust the sheet discharge timing.

Owing to the operation described above, it is possible to shorten the period of time when the intermediate transfer member 10 is left unused. In addition, images are transferred onto the two areas of the intermediate transfer member by using a developer of the same color. The number of times the developers are switched can be reduced, accordingly.

When the images supplied from the host PC 100 are printed, the host PC 100 may issue a printing order control command or a sheet discharge order-designating command in place of the system controller 1. When the printing order control command is supplied from the host PC 100 to the image forming apparatus, the printing order is controlled in such a manner that two color or monochromatic images are printed successively. When the sheet discharge order-designating command is supplied from the host PC 100 to the image forming apparatus, the order in which sheets are discharged is controlled in the manner desired by the user.

Figure 4:
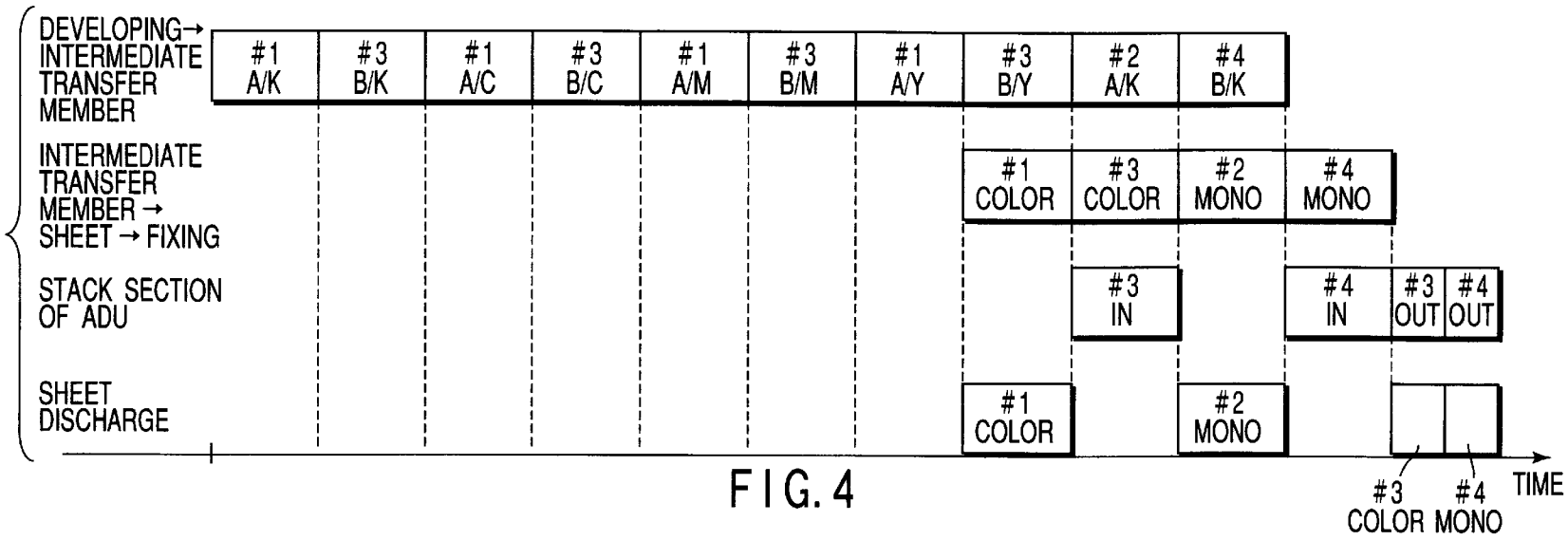
FIG. 4 illustrates how images corresponding to a number of pages are processed according to the second embodiment, when the images include color ones and monochromatic ones in combination.

With reference to FIG. 4 a description will be given as to how the apparatus of the second embodiment operates.

FIG. 4 shows a sequence in which the digital copying machine makes a copy of a document consisting of four pages. Of these four pages, the first page is a color image (#1, color), the second page is a monochromatic image (#2, mono), the third page is a color image (#3, color), and the fourth page is a monochromatic image (#4, mono).

In FIG. 4, the axis of abscissa represents time, and the processing sequences are indicated such that they are aligned in the columnar direction. In the case illustrated in FIG. 4, the four images to be printed are stored in the image data storage device 20 beforehand, and the system controller 1 reads them out of the storage device 20 in an arbitrary order.

First of all, the system controller 1 determines whether images to be printed are color ones or monochromatic ones. Based on this determination, the system controller 1 selects a pair of color images and a pair of monochromatic images. In the case illustrated in FIG. 4, the images on the first and third pages are determined to be a pair of color images, and the images on the second and fourth pages are determined to be a pair of monochromatic images.

After this determination, the system controller 1 reads out the images of the first and third pages from the image data storage device 20. The readout image of the first page is stored in area A of the page memory 1*a,* and the readout image of the third page is stored in area B of the page memory 1*b.*

The system controller 1 transfers an image, which is formed and developed on the photosensitive drum 8 in black (K), onto area A of the intermediate transfer member 10 as the first-color image corresponding to the first page (#1, A/K). Subsequently, the system controller 1 transfers an image, which is formed and developed on the photosensitive drum 8 in black (K), onto area B of the intermediate transfer member 10 as the first-color image corresponding to the third page (#3, B/K).

Subsequently, an image developed in cyan (C) and corresponding to the first page (#1, A/C) is transferred onto area A of the intermediate transfer member 10 as the second-color image. Likewise, an image developed in cyan (C) and corresponding to the third page (#3, B/C) is transferred onto area B of the intermediate transfer member 10 as the second-color image. Then, an image developed in magenta (M) and corresponding to the first page (#1, A/M) is transferred onto area A of the intermediate transfer member 10 as the third-color image. Likewise, an image developed in magenta (M) and corresponding to the third page (#3, B/M) is transferred onto area B of the intermediate transfer member 10 as the third-color image. Finally, an image developed in yellow (Y) and corresponding to the first page (#1, A/Y) is transferred onto area A of the intermediate transfer member 10 as the fourth-color image. Likewise, an image developed in yellow (Y) and corresponding to the third page (#3, B/Y) is transferred onto area B of the intermediate transfer member 10 as the fourth-color image.

In this manner, the color image corresponding to the first page is transferred onto area A of the intermediate transfer member 10, and the color image corresponding to the third page is transferred onto area B of the intermediate transfer member 10.

When the image corresponding to the first page and developed in yellow (Y) has been transferred onto area A of the intermediate transfer member 10, area A of the intermediate transfer member 10 bears the four colors required for printing a color image. At this timing, therefore, the color image corresponding to the first image is transferred from area A of the intermediate transfer member 10 onto a sheet. The image, thus transferred, is fixed on the sheet (#1, color). The sheet bearing this image is discharged onto the sheet discharge section 16 (#1, color).

When the image corresponding to the third page and developed in yellow (Y) has been transferred onto area B of the intermediate transfer member 10, a monochromatic image corresponding to the second page and developed in black (K) is transferred onto area A of the intermediate transfer member 10 (#2, A/K).

At the time, area B of the intermediate transfer member 10 bears the four colors required for printing a color image. At this timing, therefore, the color image corresponding to the third image is transferred from area B of the intermediate transfer member 10 onto a sheet. The image, thus transferred, is fixed on the sheet (#3, color). The sheet bearing this image is not discharged onto the sheet discharge section 16; it is stacked in the stack section 141 of the ADU 14 (#3, in).

When an image corresponding to the second page has been transferred onto area A of the intermediate transfer member 10, an image corresponding to the fourth page and developed in black (K) is transferred onto area B of the intermediate transfer member 10 (#4, B/K).

At the time, the image corresponding to the second page and transferred to area A of the intermediate transfer member 10 is transferred to a sheet and then fixed thereon (#2, mono). This sheet is discharged onto the sheet discharge section 16 (#2, mono). In this manner, the print results corresponding to the first and second pages are stacked on the sheet discharge section 16 in the order of pages.

Thereafter, the image corresponding to the fourth page is transferred first to area B of the intermediate transfer member 10. The image transferred to area B is then transferred to a sheet and fixed thereon (#4, mono). This sheet is not discharged onto the sheet discharge section 16 but stored in the stack section 141 of the ADU 14 (#4, in).

When the processing described above has come to an end, the sheets stacked in the stack section 141 of the ADU 14 and bearing the images corresponding to the third and fourth pages are discharged onto the sheet discharge section 16 in the regular order (#3, out), (#4, out). Accordingly, the images corresponding to the first to fourth pages are discharged onto the sheet discharge section 16.

As described above, when images to be printed include a number of color images, two of the color images are processed as a pair, and two of the monochromatic images are also processed as a pair. The two images of each pair are transferred onto the two areas of the intermediate transfer member.

Owing to this feature, the second embodiment enables a reduction in the time required for image formation when the images to be printed include color and monochromatic ones in a mixed state. Hence, image formation can be performed with high efficiency. Moreover, the images of the same kind, color or monochromatic, are developed in pairs, and the developer of the same color is used in the meantime. Accordingly, the number of times the kinds of developer are switched can be reduced, and efficient development of images is thus enabled.

As described above, color images can be transferred in pairs in the manner described above, the print results that are printed in a different order from the order of images can be stacked in the ADU, and the print results can be discharged in the same order as the order of the images.

It is, accordingly, possible to shorten the time required for image formation when the images to be formed are a combination of color and monochromatic images. In addition, the print results can be discharged in the same order as the order of the images.

A description will now be given of the third embodiment of the present invention.

According to the third embodiment, the image printing order can be controlled. In the description below, reference will be made to the case where the sheet discharge timings are controlled in such a manner that a color image is printed prior to a monochromatic image.

Like the second embodiment, the third embodiment is reduced to practice when the printing order can be controlled. For example, let us consider the case where the intermediate transfer member can bear two images, and a color image succeeds to a number of monochromatic images. In this case, the processing for the monochromatic images is executed when images of four colors are being superposed on one another.

In the case, the printed sheets are discharged in the same order as the order of the images, and it is not necessary to control the order in which the printed sheets are discharged. Hence, it is possible to shorten the period of time during which the intermediate transfer member 10 is left unused. The order of the images and the sheet discharge order can be made to agree with each other with no need to control the sheet discharging operation.

The order in which images are developed or transferred onto the intermediate transfer member 10 can be controlled based on the electronic sort function or by using the host PC 100 or printer controller 7. The type of image formed on each page of a document is detectable or is known beforehand.

The order in which images are developed or transferred to the intermediate transfer member 10 can be changed according to a certain rule. When the output of three monochromatic images is followed by the output of one color image, the printing of the color image is started before the printing of the three monochromatic images. By this control, the printing of the images comes to an end in the original image order, and the sheets can be discharged in that order.

In addition, the rule according to the printing order is changed can be used for improving the throughput when the images to be printed include color and monochromatic ones in a mixed state.

Figure 5:
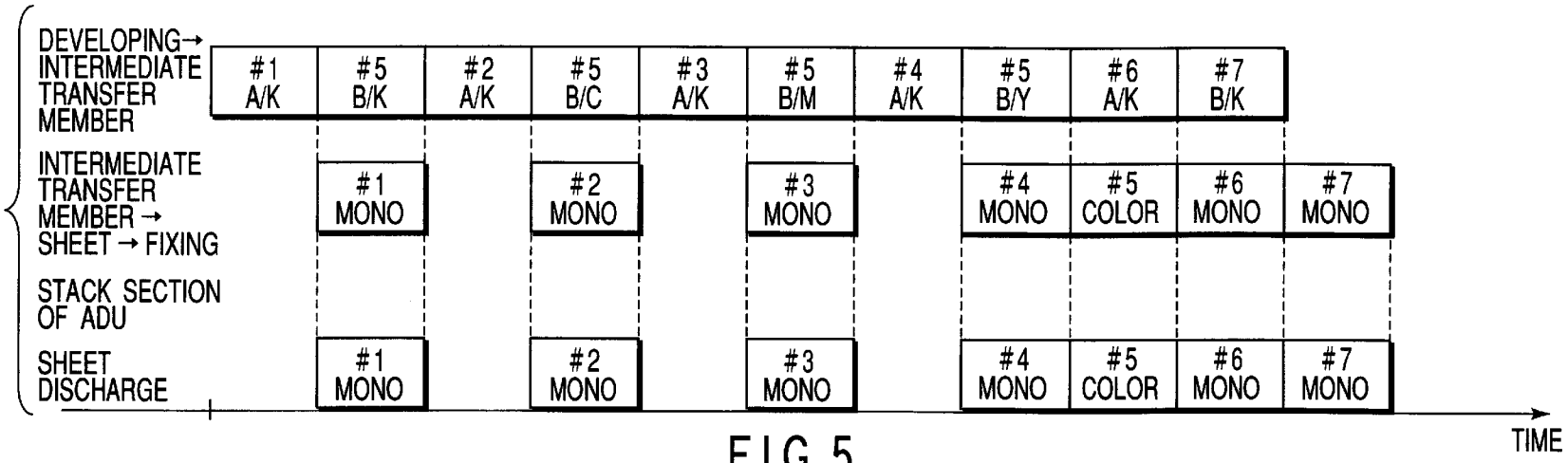
FIG. 5 illustrates how images corresponding to a number of pages are processed according to the third embodiment, when the images include color ones and monochromatic ones in combination.

With reference to FIG. 5, a description will be given as to how the apparatus of the third embodiment operates.

FIG. 5 shows a sequence in which the digital copying machine makes a copy of a document consisting of seven pages. Of these seven pages, the first page is a monochromatic image (#1, mono), the second page is a monochromatic image (#2, mono), the third page is a monochromatic image (#3, mono), the fourth page is a monochromatic image (#4, mono), the fifth page is a color image (#5, color), the sixth page is a monochromatic image (#6, mono), and the seventh page is a monochromatic image (#7, mono).

In FIG. 5, the axis of abscissa represents time, and the processing sequences are indicated such that they are aligned in the columnar direction. In the case illustrated in FIG. 5, the seven images to be printed are stored in the image data storage device 20 beforehand, and the system controller 1 reads them out of the storage device 20 in an arbitrary order.

First of all, the system controller 1 determines whether or not there is a color image that comes after three successive monochromatic images. In the case shown in FIG. 5, the first to fourth pages are determined to be monochromatic images, and the fifth page is determined to be a color image.

A monochromatic image corresponding to the first page and developed in black (K) is transferred onto area A of the intermediate transfer member 10 (#1, A/K). Subsequently, a color image corresponding to the fifth page and developed in black (K) as the first color is transferred onto area B of the intermediate transfer member 10 (#5, B/K). Simultaneous with this, the first-page image on area A is transferred to a sheet and fixed thereon, and the sheet is discharged onto the discharge section 16 (#1, mono).

A monochromatic image corresponding to the second page and developed in black (K) is transferred onto area A of the intermediate transfer member 10 (#2, A/K). Subsequently, a color image corresponding to the fifth page and developed in cyan (c) as the second color is transferred onto area B of the intermediate transfer member 10 (#5, B/C). Simultaneous with this, the second-page image on area A is transferred to a sheet and fixed thereon, and the sheet is discharged onto the discharge section 16 (#2, mono).

A monochromatic image corresponding to the third page and developed in black (K) is transferred onto area A of the intermediate transfer member 10 (#3, A/K). Subsequently, a color image corresponding to the fifth page and developed in magenta (M) as the third color is transferred onto area B of the intermediate transfer member 10 (#5, B/M). Simultaneous with this, the third-page image on area A is transferred to a sheet and fixed thereon, and the sheet is discharged onto the discharge section 16 (#3, mono).

A monochromatic image corresponding to the fourth page and developed in black (K) is transferred onto area A of the intermediate transfer member 10 (#4, A/K). Subsequently, a color image corresponding to the fifth page and developed in yellow (Y) as the fourth color is transferred onto area B of the intermediate transfer member 10 (#5, B/Y). Simultaneous with this, the fourth-page image on area A is transferred to a sheet and fixed thereon, and the sheet is discharged onto the discharge section 16 (#4, mono).

A monochromatic image corresponding to the sixth page and developed in black (K) is transferred onto area A of the intermediate transfer member 10 (#6, A/K). Until then, all four colors corresponding to the fifth-page color image are transferred, and the color image bearing all colors is transferred to a sheet and fixed thereon. The sheet bearing this color image is discharged onto the discharge section 16 (#5, color).

Then, a monochromatic image corresponding to the seventh page and developed in black (K) is transferred onto area B of the intermediate transfer member 10 (#7, B/K). Simultaneous with this, the sixth-page image on area A is transferred onto a sheet and fixed thereon, and the sheet is discharged onto the discharge section 16 (#6, mono). Finally, the seventh-page image on area A of the intermediate transfer member 10 is transferred onto a sheet and fixed thereon, and the sheet is discharged onto the discharge section 16 (#7, mono).

By these operations, print results, including color and monochromatic images in a mixed state, are discharged onto the discharge section 16 in the order of pages.

In the above description, reference was made to the case where monochromatic images are sequentially transferred to area A. In place of this operation, the colors of a color image can be transferred to area A, while simultaneously monochromatic images are transferred to area B. By doing so, the color image can be printed after the monochromatic images corresponding to three pages are printed out. In other words, the print results can be output in the same order as pages if only there are monochromatic images of at least three pages that precede a color image.

As described above, in the case where monochromatic images of at least three pages precede a color image, the monochromatic images are sequentially transferred and printed by use of one of the areas of the intermediate transfer member, with the colors of the color image being transferred and printed one by one.

Even where the images to be printed include monochromatic and color ones in a mixed state, it is possible to make good use of the areas of the intermediate transfer member, thereby improving the throughput of the printing operation. In addition, since the order in which the images are printed out agrees with the order of the images, the printed sheets need not be stacked in the ADU or the like. The printed sheets can be discharged immediately after the printing, and yet the sheet discharge order is the same as the order of the images.

According to the first to third embodiments described above, when the monochromatic and color images are printed in combination, it is not necessary to wait for the printing of a color image to be completed, and monochromatic images and a color image can be transferred onto the intermediate transfer member in parallel.

When the electronic sort function is used, or when the subject apparatus is used as a printer, the order in which the images are transferred onto the intermediate transfer member can be controlled in such a manner that the number of sheets stacked for the adjustment of sheet discharge control or the number of times developers of different colors are switched becomes a minimum. By this control, it is possible to improve the throughput of the printing operation when the images to be printed include color and monochromatic ones in a mixed state.

As described in detail, the present invention can provide an image forming apparatus which can print images including monochromatic and color ones in combination, without having to wait for the printing of a color image to be completed, and which can therefore enable monochromatic images and a color image to be transferred onto the intermediate transfer member in parallel.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image storage device for storing image data in an order of pages;

an image determination section for determining whether the image data is a single-color image which can be formed in a single color or a multi-color image which must be formed in a plurality of colors;

an intermediate transfer member for bearing an image, which is an image obtained by superposing single-color images when a determination result by the image determination section indicates the multi-color image or is an image obtained by use of the single color when the determination result by the image determination section indicates single-color image;

a control section for forming images on the intermediate transfer member in an order of pages of the image data where the intermediate transfer member can bear images corresponding to a plurality of pages, even when the images are determined to be different types by the image determination section;

a transfer section for sequentially transferring the images, formed on the intermediate transfer member by the control section, onto image formation mediums;

a fixing unit for fixing images, transferred onto the image formation mediums, to the image formation mediums;

a stack section for temporarily stacking image formation mediums bearing fixed images, when an order of the image formation mediums on which the images are fixed by the fixing unit differs from the order of the pages of the image data; and a discharge section for discharging the image formation mediums temporarily stacked in the stack section, and discharging image formation mediums bearing images that are fixed thereon after the images on the image formation mediums stacked in the image formation mediums, such that the image formation mediums are discharged in the order of the pages of the image data.

2. An image forming apparatus according to claim 1, further comprising:

a document feeder for sequentially feeding a plurality of documents, which are stacked on a document table, to a predetermined image read position one by one; and an image reader section for reading an image on a document in units of one pixel when the document is fed to the image read position by the document feeder, and for converting a read image into digital image data, said image storage device storing the image data which are produced by the image reader section when the image reader section reads the document fed by the document feeder, and said discharge section discharging the image formation mediums temporarily stacked in the stack section and discharging image formation mediums bearing images that are fixed thereon after the images on the image formation mediums stacked in the image formation mediums, such that the image formation mediums are discharged in an order in which images are read by the image reader.

3. An image forming apparatus according to claim 1, further comprising:

a printer controller for converting an image into printable image data, based on an image print command supplied from an external apparatus, said image storage device storing the image data which are produced by the printer controller, and said discharge section discharging the image formation mediums temporarily stacked in the stack section and discharging image formation mediums bearing images that are fixed thereon after the images on the image formation mediums stacked in the image formation mediums, such that the image formation mediums are discharged in an image printing order designated by an printing command supplied from the external apparatus.

4. An image forming apparatus comprising:

an image storage device for storing image data corresponding to a plurality of pages;

an image determination section for determining whether the image data is a single-color image which can be formed in a single color or a multi-color image which must be formed in a plurality of colors;

an intermediate transfer member for bearing an image, which is an image obtained by superposing single-color images when a determination result by the image determination section indicates the multi-color image or is an image obtained by use of the single color when the determination result by the image determination section indicates single-color image;

a control section for confirming that the intermediate transfer member can hold images corresponding to a plurality of pages, and then forming the multi-color image on the intermediate transfer member prior to the single-color image even if the multi-color image succeeds to the single-color image, said control section operating when the image storage device stores all image data that correspond to a plurality of pages including single-color and multi-color images in combination;

a transfer section for sequentially transferring images, formed on the intermediate transfer member by the control section, onto image formation mediums;

a fixing unit for fixing images, transferred onto the image formation mediums, to the image formation mediums; and a discharge section for discharging the image formation mediums on which images are fixed by the fixing unit.

5. An image forming apparatus according to claim 4, further comprising:

a document feeder for sequentially feeding a plurality of documents, which are stacked on a document table, to a predetermined image read position one by one; and an image reader section for reading an image on a document in units of one pixel when the document is fed to the image read position by the document feeder, and for converting a read image into image data, and said image storage device storing the image data which correspond to a plurality of pages and which are produced by the image reader section when the image reader section reads the document fed by the document feeder.

6. An image forming apparatus according to claim 4, further comprising:

a printer controller for converting an image into printable image data, based on an image print command supplied from an external apparatus, said image storage device storing the image data which correspond to a plurality of pages and are produced by the printer controller.

7. An image forming apparatus according to claim 4, further comprising:

a printer controller for converting an image into printable image data, based on an image print command supplied from an external apparatus, said image storage device storing the image data which correspond to a plurality of pages and which are produced by the printer controller, and said control section executing control based on a control command output from the external apparatus, wherein, when a single-color image succeeds to a multi-color image, the control command controlling the image formation mediums to be discharged in an order of the pages of the images, by starting formation of the multi-color image on the intermediate transfer member prior to the single-color image.

8. An image forming apparatus comprising:

an image storage device for storing image data corresponding to a plurality of pages;

an image determination section for determining whether the image data is a single-color image which can be formed in a single color or a multi-color image which must be formed in a plurality of colors;

an intermediate transfer member for bearing an image, which is an image obtained by superposing single-color images when a determination result by the image determination section indicates the multi-color image or is an image obtained by use of the single color when the determination result by the image determination section indicates single-color image;

a control section for confirming that the intermediate transfer member can hold images corresponding to a plurality of pages, and then forming images on the intermediate transfer member, such that images which are determined as being of one type by the image determination section and born on the intermediate transfer member in units of a number that can be born on the intermediate transfer member at a time, said control section operating when the image storage device stores all image data that correspond to a plurality of pages including single-color and multi-color images in combination;

a transfer section for sequentially transferring images, formed on the intermediate transfer member by the control section, onto image formation mediums;

a fixing unit for fixing images, transferred onto the image formation mediums, to the image formation mediums;

a stack section for temporarily stacking image formation mediums bearing fixed images, when an order of the image formation mediums on which the images are fixed by the fixing unit differs from the order of the pages of the image data; and a discharge section for discharging the image formation mediums temporarily stacked in the stack section, and discharging image formation mediums bearing images that are fixed thereon after the images on the image formation mediums stacked in the image formation mediums, such that the image formation mediums are discharged in the order of the pages of the image data.

9. An image forming apparatus according to claim 8, further comprising:

a document feeder for sequentially feeding a plurality of documents, which are stacked on a document table, to a predetermined image read position one by one; and an image reader section for reading an image on a document in units of one pixel when the document is fed to the image read position by the document feeder, and for converting a read image into image data, said image storage device storing the image data which correspond to a plurality of pages and which are produced by the image reader section when the image reader section reads the document fed by the document feeder, and said discharge section discharging the image formation mediums temporarily stacked in the stack section and discharging image formation mediums bearing images that are fixed thereon after the images on the image formation mediums stacked in the image formation mediums, such that the image formation mediums are discharged in an order in which the images are read by the image reader section.

10. An image forming apparatus according to claim 8, further comprising:

a printer controller for converting an image into printable image data, based on an image print command supplied from an external apparatus, said image storage device storing the image data which correspond to a plurality of pages and are produced by the printer controller, and said discharge section discharging the image formation mediums temporarily stacked in the stack section and discharging image formation mediums bearing images that are fixed thereon after the images on the image formation mediums stacked in the image formation mediums, such that the image formation mediums are discharged in an image printing order designated by a printing command supplied from the external apparatus.

11. An image forming apparatus according to claim 8, further comprising:

a printer controller for converting an image into printable image data, based on an image print command supplied from an external apparatus, said image storage device storing the image data which correspond to a plurality of pages and which are produced by the printer controller, said control section executing control based on a control command output from the external apparatus, said control command enabling the intermediate transfer member to hold images corresponding to a plurality of pages, and then forming images on the intermediate transfer member, such that images which are determined as being of one type by the image determination section and born on the intermediate transfer member in unit of a number that can be born on the intermediate transfer member at a time, said control command being issued when the image storage device stores all image data that correspond to a plurality of pages including single-color and multi-color images in combination, said discharge section discharging the image formation mediums based on a discharge command supplied from the external apparatus, said discharge command controlling discharge of the image formation mediums temporarily stacked in the stack section and image formation mediums bearing images that are fixed thereon after the images on the image formation mediums stacked in the image formation mediums, such that the image formation mediums are discharged in an image printing order designated by a printing command supplied from the external apparatus.

* * * * *